United States Patent [19]

Congdon

[11] Patent Number: 5,018,116

[45] Date of Patent: May 21, 1991

[54] INTER-ELEMENT MOUNTING FOR STACKED PIEZOELECTRIC TRANSDUCERS

[75] Inventor: John C. Congdon, Fort Wayne, Ind.

[73] Assignee: Magnavox Government and Industrial Electronics Company, Fort Wayne, Ind.

[21] Appl. No.: 532,714

[22] Filed: May 4, 1990

[51] Int. Cl.[5] ..... H04R 17/00

[52] U.S. Cl. ..... 367/165; 310/334

[58] Field of Search ..... 310/337, 326, 334, 345-353; 367/157-162, 165, 167

[56] References Cited

U.S. PATENT DOCUMENTS

| | | | |
|---|---|---|---|
| 3,353,150 | 11/1967 | Jacox | 367/159 |
| 3,713,086 | 1/1973 | Trott | 367/159 |
| 3,781,781 | 12/1973 | Groves, Jr. | 367/159 |

*Primary Examiner*—Brian S. Steinberger

*Attorney, Agent, or Firm*—Roger M. Rickert; Richard T. Seeger

[57] ABSTRACT

In a preferred embodiment, an inter-element mounting for ceramic elements in a piezoelectric transducer stack, which mounting includes two metal plates disposed between adjacent surfaces of the ceramic elements. The metal plates are cantilevered with respect to the surfaces of the ceramic elements, such that a substantial portion of the areas of the plates between the adjacent surfaces is unsupported and, therefore, the plates have a high degree of resilience. This structure provides controlled vibrational characteristics, structural integrity for high hydrostatic pressure, versatility in design for spurious resonance suppression or elimination, dampening, and special utility for pressure gradient hydrophone stacks.

7 Claims, 3 Drawing Sheets

INTER-ELEMENT MOUNTING FOR STACKED PIEZOELECTRIC TRANSDUCERS

BACKGROUND OF THE INVENTION

1. Field of the Invention

The present invention relates to transducers generally and, more particularly, to a novel element for vibrationally isolating the stacked piezoelectric ceramic plates found in some types of transducers and which is particularly useful in low-frequency, pressure gradient hydrophones.

2. Background Art

Piezoelectric elements are well known devices which change dimensionally when an electric potential is applied across them and which produce an electric potential when subjected to an external force.

A transducer of particular interest here is the stacked piezoelectric ceramic transducer having usefulness in hydrophones for detecting underwater sounds. Such a transducer includes a stack of piezoelectric ceramic plates that are electrically connected in parallel and provides an electric potential when an acoustic wave is received. Ideally, each ceramic plate is resiliently mounted so as to be able to vibrate completely independently of other plates. A particular problem exists with such hydrophones operating in a pressure gradient mode, that is, one in which the directional bearing of an acoustic wave, as well as amplitude thereof, is detected, in that they are highly susceptible to spurious resonances created by the interaction of the various components of the hydrophone itself.

It is desirable that such transducers be able to perform at low frequencies however, heretofore, conventional pressure gradient transducers have been limited, in that spurious resonances in the low frequency bands of interest are generated in the stack of transducer elements because of imperfect vibrational isolation. This is a particular problem when the band of interest approaches the resonant frequency of the components of the ceramic stack. Improved pressure gradient response free of spurious resonances would mean greater bearing accuracy. Freedom from spurious resonances is achieved when inter-element resonance is eliminated.

Designers of conventional hydrophone transducers first attempted to solve the problem of spurious resonances by interposing pads of resilient material between the surfaces of adjacent pairs of ceramic elements. This improved performance, but high bearing error existed on many hydrophones at a low frequency in the band where a spurious resonance resided. In a later development, there was disposed between each pair of ceramic elements a sandwich structure comprising a perforated metal annulus, with resilient annuli on either side thereof. While this construction alleviated the problem somewhat, the mounting still was too stiff and there still remained an undesirable vibrational signal level caused by the spurious resonances.

Accordingly, it is a principal object of the present invention to provide a piezoelectric ceramic stack transducer which can be operated at low frequencies without spurious resonances.

It is another object of the invention to provide an inter-element mounting between each pair of ceramic elements in such a transducer, which mounting decreases the stiffness of the coupling between the elements as compared to the previous resilient mounting, to increase vibrational isolation thereof.

It is an additional object of the invention to provide an improved ceramic stack for such transducers which can be used in existing installations.

It is a further object of the invention to provide such a ceramic stack which is easily and economically manufactured.

It is yet another object of the invention to provide an improved transducer stack, which stack particularly improves the response of pressure gradient hydrophones.

Other objects of the present invention, as well as particular features and advantages thereof, will be elucidated in, or be apparent from, the following description and the accompanying drawing figures.

SUMMARY OF THE INVENTION

The above objects, among others, are achieved by providing, in a preferred embodiment, an inter-element mounting for ceramic elements in a piezoelectric transducer stack, which mounting includes two metal plates disposed between adjacent surfaces of the ceramic elements. The metal plates are cantilevered with respect to the surfaces of the ceramic elements, such that a substantial portion of the areas of the plates between the adjacent surfaces is unsupported and, therefore, the plates have a high degree of resilience. This structure provides controlled vibrational characteristics, structural integrity for high hydrostatic pressure, versatility in design for spurious resonance suppression or elimination, dampening, and special utility for pressure gradient hydrophone stacks.

BRIEF DESCRIPTION OF THE DRAWING

The invention will be better understood if reference is made to the accompanying drawing figures, in which.

DETAILED DESCRIPTION OF THE PREFERRED EMBODIMENTS

Figure 1:
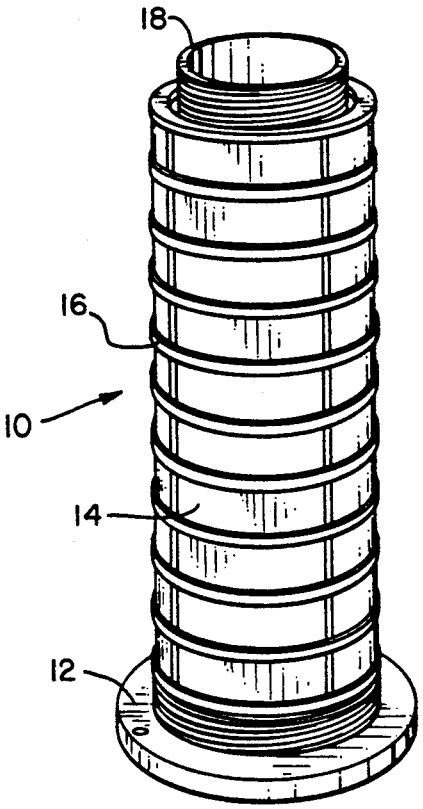
FIG. 1 is a perspective view of a stack of ceramic elements, constructed according to the present invention.

Referring now to the Drawing, on which the same or similar elements are given consistent identifying numerals throughout the various figures thereof, FIG. 1 is a view of a stack of ceramic elements constructed according to the present invention, the stack generally indicated by the reference numeral 10, mounted on a flange 12 and including a plurality of annular ceramic elements, as at 14, being separated on from another by a plurality of inter-element mountings, as at 16. The details of the construction of inter-element mountings 16 will be described below. Ceramic elements 14 are supported against radial movement by centering tube 18.

Figure 2:
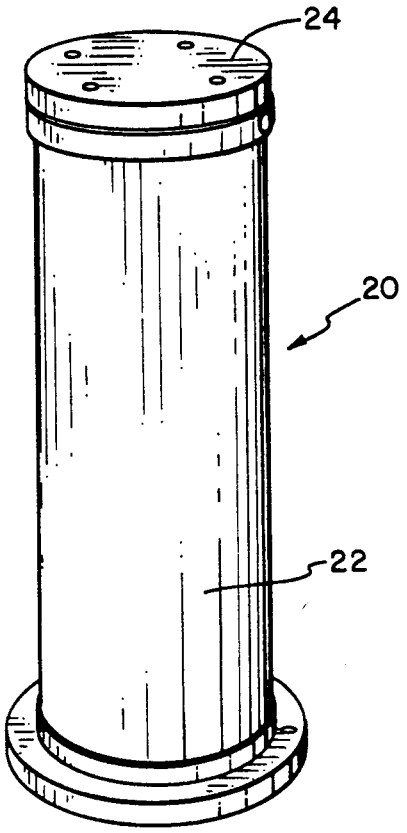
( PRIOR ART ) FIG. 2
FIG. 2 is a perspective view of a complete hydrophone transducer.

FIG. 2 is a view of a complete hydrophone, generally indicated by the reference numeral 20, in which there is disposed a ceramic stack (not shown), which stack may be ceramic stack 10 (FIG. 1) or may be a conventionally constructed ceramic stack. Hydrophone 20 includes a outer rubber boot 22 covering the ceramic stack and between the stack and the inner surface of the boot is a layer of polyurethane elastomer (not shown) which bonds the boot to the stack and serves as an acoustical transfer agent to transfer sound pressure waves to the stack. Hydrophone 20 has a cover plate 24 at the top thereof. Flange 12 is used to mount hydrophone 20 inside a protective dome formed on the hull of a watercraft, either surface or submarine, but the hydrophone could also be adapted to be used in a sonobuoy.

Figure 3:
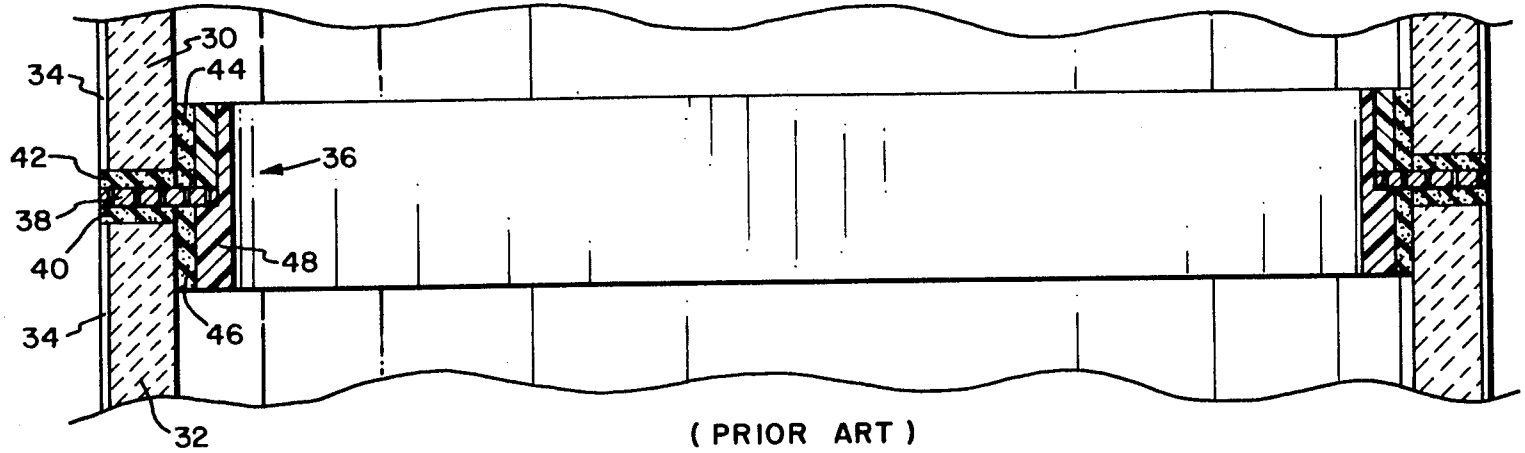
(PRIOR ART) FIG. 3
FIG. 3 is a fragmentary, cross-sectional, elevational view showing the conventional construction of a stack of ceramic elements for a hydrophone transducer.

FIG. 3 illustrates the construction details of a conventional inter-element mounting. Here, two annular, piezoelectric ceramic elements 30 and 32, the outer surfaces of which are covered with fiberglass roving 34 to protect and prestress the ceramic elements, are separated by an inter-element mounting, generally indicated by the reference numeral 86. Inter-element mounting 86 includes a perforated, annular metal plate 88, and on either side of which plate between the surfaces of the plate and the adjacent ends of ceramic elements 30 and 32 are disposed resilient annuli 40 and 42. Resilient annular mounting straps 44 and 46 are disposed around the inner walls of ceramic elements 30 and 32 for internal vibration isolation of the ceramic elements. An annular, two-piece backing ring assembly 48 is fitted around the inner circumference of perforated plate 38 and against the inner surfaces of mounting straps 44 and 46. Backing ring 48 is supported by centering tube 18 (FIG. 1), and between the backing ring and the centering tube are thin resilient spacers (neither shown on FIG. 8). Resilient annuli 40 and 42 and resilient mounting straps 44 and 46 are formed from known resilient materials such as corprene, rubber, and various polymerics. Backing ring 48 is formed from phenolic material. Perforated plate 38 is provided with perforations to reduce the contact area of the plate with resilient annuli 40 and 42 to increase the compliance of the annuli, thereby lowering the resonant frequencies of the combinations of the ceramic elements 32 and 34 with the adjacent respective annuli. While ceramic elements 30 and 32 are somewhat vibrationally isolated in the conventional design shown, the degree of such isolation is limited, since the adjacent elements 42, 38, and 40 of the inter-element mounting 36 are fully in contact with one another.

Figure 4:
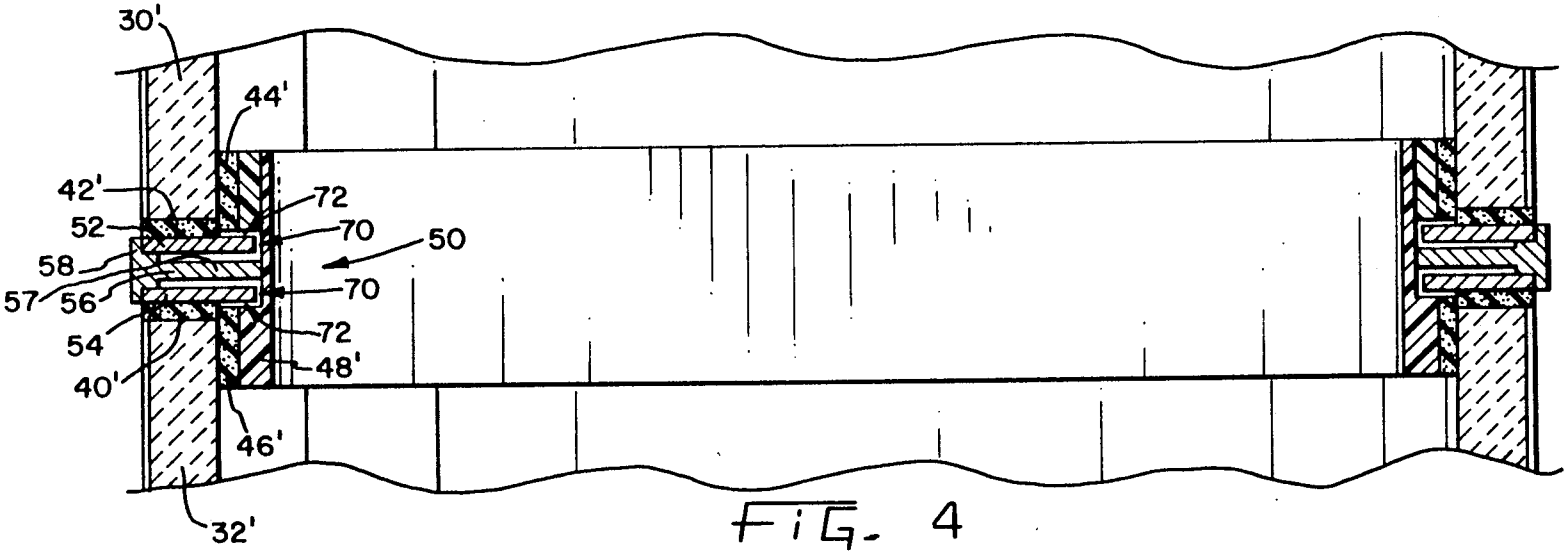
FIG. 4 is a fragmentary, cross-sectional, elevational view showing the construction of a stack of ceramic elements for a hydrophone transducer, constructed according to the present invention.

FIG. 4 illustrates an inter-element mounting constructed according to the present invention, generally indicated by the reference numeral 50. Elements similar to, and having the same functions as, those in the conventional construction illustrated on FIG. 3 are given primed reference numerals. Here, mounting 50 includes two annular, metal, parallel plates 62 and 84 disposed between resilient annuli 40' and 42'. Plates 52 and 54 are themselves separated by a T-shaped metal mounting annulus 56 having an outer annular flange or band 58. It can be seen that the top of T-shaped mounting annulus 56 engages a small area of the facing surfaces of perforated plates 52 and 54 near the outer circumference of the plates, thus separating and supporting the plates. The inner end of mounting annulus 56 engages backing plate 48', while band 58 engages the outer circumferences of plates 52 and 54. The annular web 67 interconnects the band 58 with the inner end of mounting annulus 56. The substantially cantilevered structure of plates 52 and 54 gives them a relatively high degree of springiness, thus affording a high degree of isolation of ceramic elements 30' and 32'. The web 57 compresses radially much less readily than it flexes in the axial direction providing an enhanced structural integrity under high hydrostatic pressure conditions.

In order that the interior ends of plates 52 and 54 may move freely, spaces 70 are provided between the inner circumferences of the plates and backing ring 48', and spaces 72 are provided between: (1) the surfaces of the portions of plates 52 and 54 extending interiorly of ceramic elements 30' and 32' and (2) the adjacent surfaces of mounting straps 44' and 46' and backing plate 48'.

Plates 52 and 54 can be solid, as shown, or they may be perforated, as is plate 38 of FIG. 3. Being able to thus adjust the compliance of the plates 52 and 54, together with the ability to adjust the compliance of annuli 40' and 42', results in a great deal of design flexibility to accommodate a variety of situations where it is desired to shift the location of, bandwidth of, or to tune out, spurious frequencies.

It will be understood that an inter-element mounting of the type shown on FIG. 4 would be provided between each pair of ceramic elements in the stack.

Since the overall construction of a ceramic element stack according to the present invention is essentially the same as conventionally constructed stacks, it may be easily retrofitted to existing installations.

Figure 5:
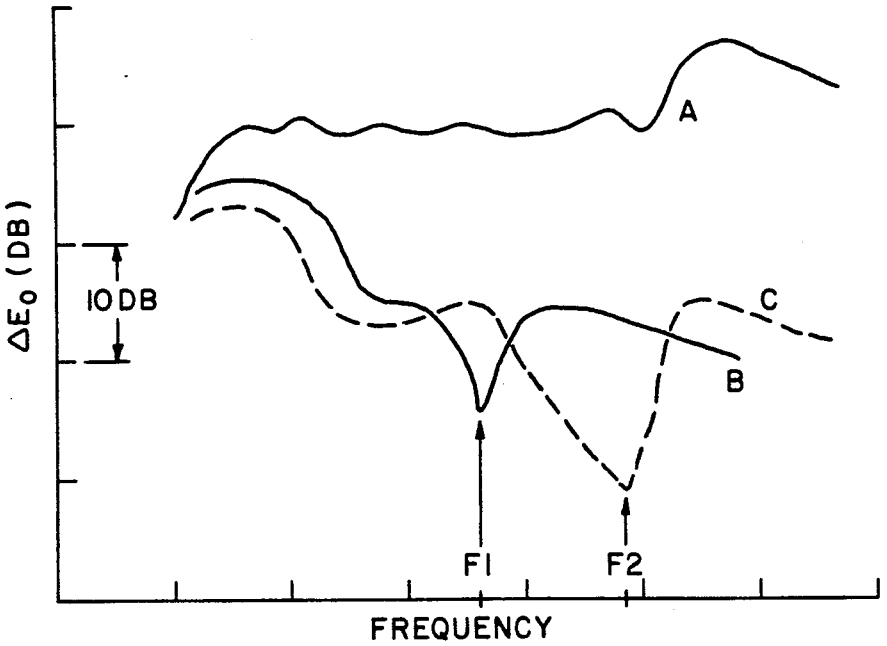
FIG. 5 is a graph illustrating the improvement in performance of the stack of FIG. 4 over the stack of FIG. 3.
Figure 6:
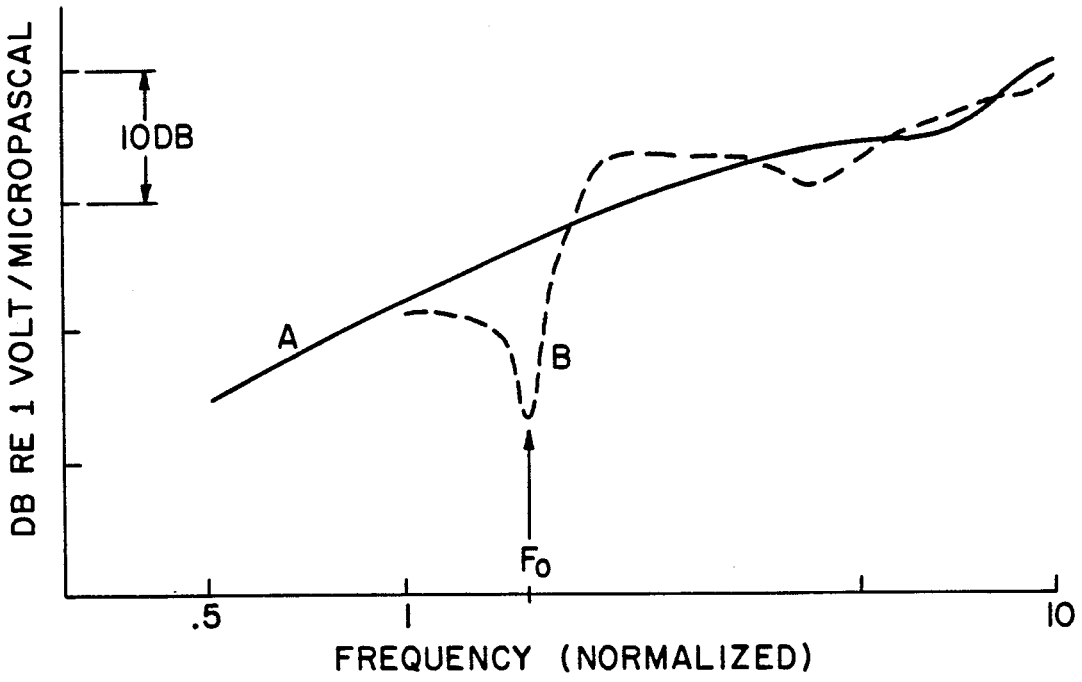
FIG. 6 is a graph similar to FIG. 5 showing the improvement in low temperature performance attainable with the present invention.

FIG. 5 illustrates the improvement of performance of a ceramic stack constructed with inter-element mountings, such as mounting 50 on FIG. 4, as compared with a ceramic stack constructed with inter-element mountings, such as mounting 36 on FIG. 3. Curve A was produced by a ceramic stack constructed according to the present invention (FIG. 4) and demonstrates no spurious frequencies. Curves B and C were produced by a conventionally constructed ceramic stack (FIG. 8) under two different degrees of compression and demonstrate detrimental spurious resonances at frequencies F1 and F2, respectively. These resonances appear as dips because the ordinate (output) was measured as the difference between two voltages. FIG. 6 provides a similar, but more striking comparison of conventional stack mounting (curve B) compared to the actual response of a hydrophone utilizing the mounting technique of the present invention (curve A) at a relatively low temperature, six degrees Celsius in the particular illustration. The curves of FIG. 6 compare receiving voltage sensitivities as a function of a normalized (scaled for the size of the unit) frequency. Notice the pronounced spurious response of the prior art device at $F_o$. The absence of spurious resonances in the present invention permits the performance capability of a hydrophone employing the inter-element mounting of the present invention to be extended to much lower frequencies.

While the present invention has been described as being applied to annular ceramic plates, it will be understood that it may be applied as well to plates of any shape which require vibrational isolation of this nature. It will be understood also that, although the invention as described has been applied to optimizing a hydrophone transducer receiver, it is also within the intent of the present invention that it may be applied as well to separating ceramic elements in a transmitter or in any other similar transducer structure which exhibits undesirable spurious resonances.

It will thus be seen that the objects set forth above, among those made apparent from the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An inter-element mounting for use between adjacent surfaces of two piezoelectric ceramic elements of a transducer stack, comprising: mechanical spring members disposed between said adjacent surfaces to vibrationally isolate said ceramic elements one from the other, said mechanical spring members comprising two plates disposed parallel to said surfaces, said plates being cantilevered such that at least a substantial portion of the areas of said plates between said surfaces are unsupported with respect to each other.

2. An inter-element mounting, as defined in claim 1, further comprising layers of resilient material disposed between said plates and said surfaces.

3. An inter-element mounting, as defined in claim 1, wherein:

(a) said ceramic elements are annular;

(b) said spring members are annular plates having radially inner and radially outer edges; and (c) said annular plates are held separated one from the other by support means which engages a portion of said annular plates near radially outer edges thereof.

4. An inter-element mounting, as defined in claim 3 wherein the support means comprises an radially rigid annulus for holding and separating the annular plates.

5. An inter-element mounting, as defined in claim 4, wherein the annulus is generally T-shaped in cross-section having an outer axially extending band which engages the annular plates and a radially extending annular web which compresses radially much less readily than it flexes in other direction.

6. In a pressure gradient hydrophone, the improvement comprising a stack of axially aligned annular piezoelectric transducer elements, and vibration isolating spacing means between each adjacent pair of elements, each vibration isolating spacing means including a pair of annular cantilevered rims with the free ends thereof extending radially inwardly and with the outer peripheries thereof joined.

7. The improvement of claim 6 wherein each vibration isolating spacing means includes a pair of resilient annuli, each one interposed between and engaging a cantilevered rim and corresponding one of the piezoelectric transducer elements.

* * * * *